United States Patent [19]

Koinuma et al.

[11] 4,204,138

[45] May 20, 1980

[54] PERMANENT MAGNET-CONTAINING MAGNETRON

[75] Inventors: Tokuju Koinuma, Kawasaki; Norio Tashiro, Yokohama, both of Japan

[73] Assignee: Tokyo Shibaura Electric Co., Ltd., Kawasaki, Japan

[21] Appl. No.: 897,726

[22] Filed: Apr. 19, 1978

[30] Foreign Application Priority Data

Apr. 27, 1977 [JP] Japan ..... 52-53700[U]

[51] Int. Cl.[2] ..... H01J 25/50

[52] U.S. Cl. ..... 315/39.51; 315/39.53; 315/39.71

[58] Field of Search ..... 315/39.51, 39.53, 39.75, 315/39.71

[56] References Cited

U.S. PATENT DOCUMENTS

| | | | |
|---|---|---|---|
| 3,588,588 | 6/1971 | Numata | 315/39.53 |
| 3,936,766 | 2/1976 | Staats | 315/39.53 |
| 3,967,087 | 6/1976 | Kanuma | 315/39.51 |
| 3,987,333 | 10/1976 | Nakada et al. | 315/39.71 |
| 4,042,851 | 8/1977 | Yasuoka et al. | 315/39.71 |
| 4,071,804 | 1/1978 | Koinuma et al. | 315/39.71 |

*Primary Examiner*—Saxfield Chatmon, Jr.

*Attorney, Agent, or Firm*—Cushman, Darby & Cushman

[57] ABSTRACT

The magnetron of this invention comprises permanent magnets, resonant cavity unit and microwave-oscillating member such as a filament all set in a cylindrical yoke made of soft magnetic material and used as an evacuated envelope. The magnetron is forced into an opening bored in a fitting board, or inserted into said opening, followed by tightening. This fitting board enables the magnetron to be easily mounted on a waveguide or microwave oven.

3 Claims, 4 Drawing Figures

PERMANENT MAGNET-CONTAINING MAGNETRON

BACKGROUND OF THE INVENTION

This invention relates to a magnetron, and more particularly to an internal permanent magnet type magnetron which can be firmly fitted to a microwave-receiving member such as a waveguide or microwave oven (hereinafter referred to as "a waveguide").

Recently developed is a magnetron, in the evacuated envelope of which there are received permanent magnets for creating a microwave-generating electric field, together with, for example, an anode, cathode and filament. Said recently developed internal permanent magnet type magnetron whose evacuated envelope made of magnetic metal is used by itself as the return path of a magnetic circuit, offers the advantages that it is unnecessary to provide a magnetic yoke made of magnetic material in addition to copper evacuated envelope as is the case with the prior art magnetron having permanent magnets disposed outside of the evacuated envelope; the magnetron has a simplified construction; the permanent magnets can be located near an optimum region for creation of microwaves; and the permanent magnets and in consequence the associated magnetic circuit can be made compact. However, the above-mentioned recently developed magnetron lacks proper means for fitting said magnetron to, for example, a waveguide. Therefore, it has been demanded to invent means for reliably fitting said magnetron to, for example, a waveguide. Particularly in recent years when a magnetron is used with a microwave oven widely in the general household, a strong demand has been directed to the development of means for securely mounting the magnetron on the microwave oven, to which the microwave oven may probably be subject during transportation or handling.

SUMMARY OF THE INVENTION

It is accordingly the object of this invention to provide an internal permanent type magnetron capable of being securely mounted on, for example, a waveguide.

According to the invention, there is provided an internal permanent type magnetron which comprises an evacuated cylindrical yoke of soft magnetic material which is formed of a cup member closed at one end and open at the other and an end cap covering said open end hermetically, a resonant cavity unit coaxially disposed with the yoke, provided with a central space and used as an anode; a filament set in the central space to be concurrently used as a cathode; at least one permanent magnet received in the yoke to create a magnetic field for driving the resonant cavity unit in co-operation with the yoke; antenna means connected to the resonant cavity unit and designed to penetrate the end cap hermetically and extend from the resonant cavity unit to the outside in the axial direction of the yoke; and a fitting board which is bored at the center with a round opening into which the cup member is inserted.

The magnetron of this invention comprises a yoke of soft magnetic material which concurrently acts as a carrier for supporting almost the whole weight of the magnetron except for the fitting board. Accordingly, the magnetron as a whole takes a rigid, substantially round columnar simple shape. The columnar or cylindrical yoke, for example, when tightly fitted into the round opening of the fitting board enables the magnetron to be securely mounted on a microwave-receiving member, for example, the previously defined waveguide.

DETAILED DESCRIPTION OF THE PREFERRED EMBODIMENTS

Figure 1:
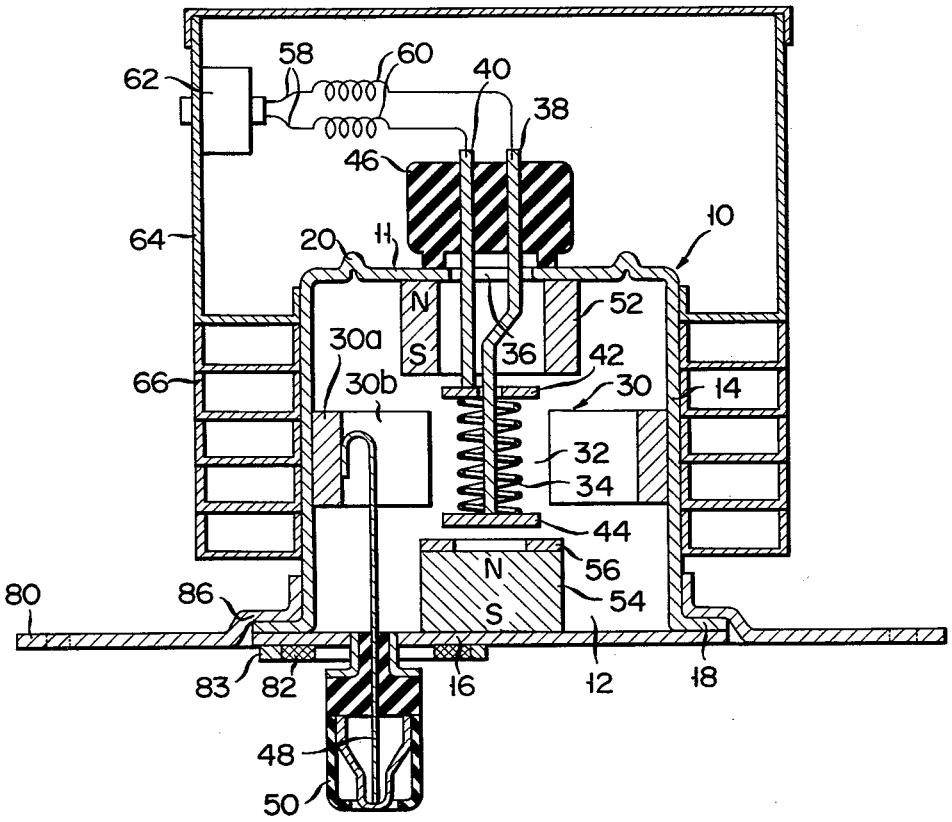
FIG. 1 is a longitudinal sectional view of the magnetron of this invention.
Figure 2:
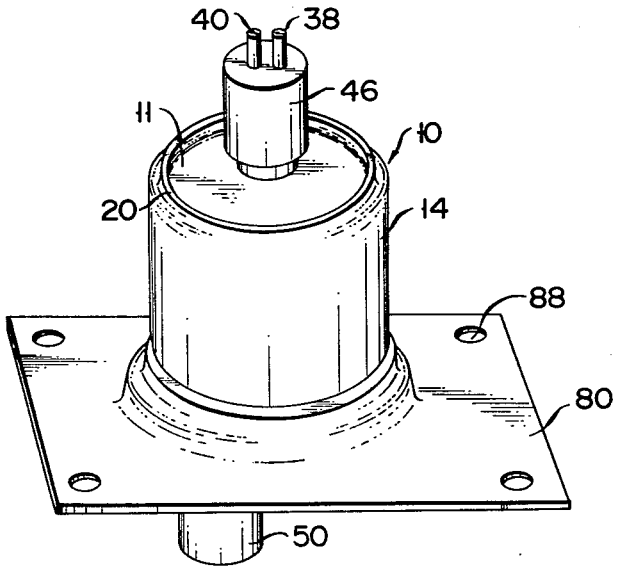
FIG. 2 is an oblique view illustrating the manner in which the yoke, stem and fitting board are assembled.

FIG. 1 is a longitudinal sectional view of an internal permanent magnet type magnetron embodying this invention. FIG. 2 is an oblique view of the magnetron of FIG. 1 stripped of radiator fins, shield box, two choke coils connected to a filament and capacitor.

Referring to FIG. 1, reference numeral 10 denotes an evacuated cylindrical yoke made of soft magnetic material for use as a evacuated envelope. The yoke 10 includes an inverted cup member 14 covered at one end with a ceiling 11 and an end cap 16 closing the other open end portion 12 of said cup member 14 hermetically by means of, for example, welding. The open end portion 12 of the cup member 14 is provided with an outward projecting flange 18. The end cap 16 abuts against the flange 18 to close the open end portion 12 of the cup member 14. An annular rib 20 is provided for reinforcement on the periphery of the outer wall of the ceiling 11 of the cup member 14.

Reference numeral 30 denotes a resonant cavity unit fitted to the inner wall of the cup member 14 coaxially therewith concurrently to be used as an anode. This resonant cavity unit 30 comprises an annular section **30*a* mainly made of good heat conducting material such as copper, and a plurality of anode vanes 30*b* integrally formed or engaged with the annular section 30*a*, which are also made of good heat conducting material such as copper and radially project from the annular section 30*a* toward the center of a circle defined thereby. A coil filament 34 concurrently used as a cathode is set in the central space defined by the convergent end portions of the anode vanes 30*b*. An annular space which is designated as an interaction space 32 is defined between the convergent end portions of the anode vanes 30*b* and the coil filament 34. Both ends of the coil filament 34 are connected to end hats 42, 44 attached to the lower ends of a pair of conducting rods 38, 40 which extend upward through an opening 36 bored in the ceiling 11 of the cup member 14. Referential numeral 46 denotes a cathode stem made of electrically insulating material, positioned on the outside of the ceiling 11 of the cup member 14 to close hermetically the opening 36 of said ceiling 11. The conducting rods 38, 40 penetrate the cathode stem 46 hermetically and extend up to the aforesaid interaction space 32. Referential numeral 48 is an output antenna rod for conducting microwaves issued from the resonant cavity unit 30 to the outside through the end cap 16. The output antenna rod 48 is connected to an output antenna 50 which penetrates the end cap 16 at a point radially displaced from the axis of the cup member 14, or the axis of the magnetron and is fitted to said end cap 16** hermetically.

An annular permanent magnet 52 fitted to the inner wall of the ceiling 11 and a columnar permanent magnet 54 mounted on the inner wall of the end cap 16 (hereinafter referred to as "the magnets") are arranged across the interaction space 32 in the axial direction of the magnetron. The upper end of the magnet 54 is provided with a pole piece 56. The magnets 52, 54 are so arranged as to cause their magnetomotive forces to be added together. A magnetic flux issued from the N pole of the magnet 52 passes through the ceiling 11 of the cup member 14, the cavity thereof and end cap 16 into the S pole of the magnet 54. Thereafter, the magnetic flux is sent forth from the N pole of said magnet 54 and pole piece 56 to create a magnetic field for driving the resonant cavity unit 30, and then is brought back to the S pole of the magnet 52.

The conducting rods 38, 40 projecting from the stem 46 are connected to a pair of lead wires 58 supplied with a filament current from an external circuit (not shown) and impressed with high negative voltage. Reference numeral 60 denotes a pair of choke coils connected to the paired lead wires 58 respectively. Referential numeral 62 denotes a through type capacitor which cooperates with the paired choke coils 60 to act as a filter for preventing microwave current from leaking out of the filament to the outside.

Reference numeral 6A shows a shield box for preventing microwaves from being radiated out of the various sections lying between the outer end portions of the conducting rods 38, 40 and the through type capacitor 62. The shield box 64 is mounted on the outer wall of the ceiling 11 of the cup member 14. A plurality of radially arranged radiator fins 66 are fitted to the inner wall of the cup member 14.

Reference numeral 80 is a fitting board bored at the center with a round opening into which the cup member 14 is inserted. The fitting board 80 is used to mount the magnetron on, for example, the previously defined waveguide (not shown). Referential numeral 82 denotes a electrically conductive gasket disposed between the fitting board 80 and the waveguide mounted thereon. Said gasket 82 is received in a ring-shaped gasket-fitting metal part 83 fixed to the end cap 16 by means of, for example, welding. The fitting board 80 is later further detailed.

The interior of the cylindrical yoke of the magnetron in which the above-mentioned various members are assembled is highly evacuated. Where, under such evacuated condition, prescribed value of current is conducted through the filament 34, and a higher negative voltage with respect to the anode vanes **30*b* is impressed thereon, then microwaves are generated in the resonant cavity unit 30. The microwaves are drawn out to the waveguide through the output antenna 50**.

Figure 3:
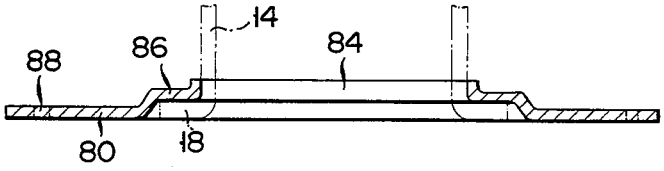
FIG. 3 is a cross sectional view of the fitting board shown in FIG. 1.

The cup member 14 may be securely mounted on the fitting board 80 by various processes with the engagement section of both members 14, 80 shaped into the form adapted for each process. A magnetron constructed as shown in FIG. 1 is one of the most preferred embodiments. That outer end portion of the cup member 14 which faces the output antenna 50 is provided with an outward projecting flange 18. The peripheral portion of a through opening 84 shown in FIG. 3 (round in this case) bored in the fitting board 80 into which the cup member 14 is inserted is provided with a flange rest 86 closely engageable with the outward projecting flange 18 (indicated by dot-dash lines). Where, therefore, the cup member 14 is forced into the round through opening 84 having a proper diameter, then close engagement takes place between the flange 18 and flange rest 86, thereby attaining the tight coupling of both cup member 14 and fitting board 80.

The point of the peripheral surface of the cup member 14 (namely, the cylindrical yoke) at which said cup member 14 is engaged with the fitting board 80 need not be restricted to the lower end portion of said cup member 14, but may be set in the intermediate portion thereof. With the foregoing embodiment, the flange 18 formed at the lower end portion of the cup member 14 is engaged with the flange rest 86 provided on the periphery of the round through opening 84 of the fitting board 80. Obviously, it is possible to force the cup member 14 into the round through opening 84 without using the above-mentioned flange 18 and flange rest 86.

Figure 4:
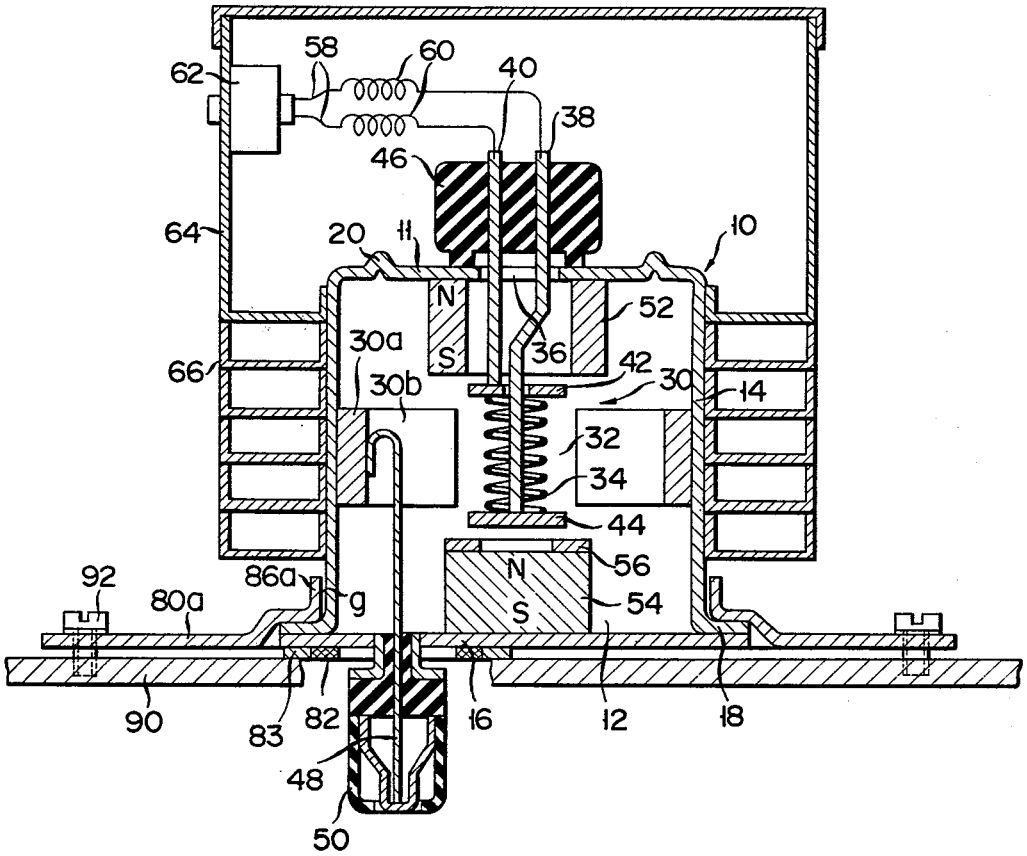
FIG. 4 is a cross sectional view of the cup member fitted into the round opening of a different fitting board from that of FIG. 1.

FIG. 4 represents another embodiment of the magnetron of the invention in which the cup member 14 is made rotatable relative to the fitting board **80*a*, thereby enabling the magnetron to be mounted on the waveguide with the cup member 14 positioned in the desired direction relative to the fitting board 80*a*. According to this second embodiment, a gap g is provided between the flange 18 of the cup member 14 and the rising portion 86*a* of the flange rest 86 of the fitting board 80*a*. Where, therefore, the fitting board 80*a* is mounted on the waveguide 90 by means of screws 92 and screw holes 88 (FIG. 2), the cup member 14 is loosely fitted for rotation into the round through opening 84 of the fitting board 80*a*. Where the screws 92 are loosened after the fitting board 80*a* is set on the waveguide 90, then the flange 18 of the cup member 14 and the flange rest 86 of the fitting board 80*a* are loosely engaged with each other. Consequently, where the screws 92 are tightened after the cup member 14**, together with the parts fitted thereto, is rotated to the desired position, then the cup member assembly can be tightly mounted on the waveguide in a state rotated in the desired direction. The above-mentioned arrangement enables the magnetron of this invention to be set in any proper position without difficulties, even when the component members of an electric appliance using a magnetron are made to be connected to the filament terminals or radiator fins in a different manner.

The second embodiment of this invention in which the magnetron is constructed as shown in FIG. 4 to admit of the rotation of the cup member 14 is particularly useful for the magnetron whose projecting output antenna 50 is radially displaced from the axis of the cup member 14. The reason is that rotation of the cup member 14 shifts the position of the output antenna 50 relative to the waveguide, thereby making it possible to adjust to a certain extent the manner in which the magnetron is electronically coupled with the waveguide.

The foregoing embodiments refer to the construction by which the cup member 14 is engaged with the fitting board 80 or **80*a*. In either case, the cup member 14 carrying the main members on the outside or inside can be tightly fitted into the through opening 84 bored in the fitting board 80 or 80*a*. Therefore, magnetron is securely supported by the fitting board 80 or 80*a*, and consequently, when mounted on the waveguide, is effectively prevented from being loosened from the fitting board 80 or 80*a*** or damaged under any vibrations or shocks.

The reason why the cup member 14 can be securely fitted into the round through opening 84 of the fitting board 80 or 80*a* is that the magnets 52, 54 are received in a cylindrical yoke 10; the magnetron is allowed to have a simple cylindrical form; the yoke 10 which is made of soft magnetic material with a greater mechanical strength than the prior art copper vacuum envelope encloses the magnetron; the yoke 10 can be made to undergo a large force for securely fixing the magnetron; and the cup member 14 is not subject to deformation when inserted forcefully into the round through opening 84 of the rigid fitting board 80, or tightly coupled with the fitting board 80*a*.

The above-mentioned fitting board 80 or 80*a* enables a magnet-containing magnetron to be easily constructed with a light weight and securely mounted on, for example, a waveguide or a microwave oven.

The fitting board 80 or 80*a* into the through opening of which there is inserted the cup member 14 containing a heat-generating portion and acting as the yoke 10 effectively radiates heat as a radiation fin.

What we claim is:

1. A magnetron comprising:

a highly evacuated cylindrical yoke cup member fabricated from a soft magnetic material, said cup member including a flange at its open end;

a resonant cavity unit having a plurality of anode vanes disposed coaxially within said yoke cup member, said anode vanes defining a central space within said yoke cup member;

a cathode positioned within said central space;

at least one permanent magnet within said cup member for driving said resonant cavity unit in cooperation with said cup member;

an end cap made of soft magnetic material for hermetically sealing the open end of said cup member;

an antenna;

means for coupling said antenna through said end cap to said resonant cavity; and a fitting board having a bore therethrough, said bore having a diameter larger than that of said yoke cup member without said flange and smaller than the diameter of said cup member including said flange, said fitting board further including a flange rest about said bore, the closed end of said yoke cup member being inserted through said bore such that said flange of said yoke cup member engages said flange rest when said cup member is inserted through said bore.

2. A magnetron comprising:

a highly evacuated cylindrical yoke cup member fabricated from a soft magnetic material, said cup member including a substantially horizontal flange at its open end;

a resonant cavity unit having a plurality of anode vanes disposed coaxially within said cup member, said anode vanes defining a central space within said cup member;

a cathode positioned within said central space;

at least one permanent magnet within said cup member for driving said resonant cavity unit in cooperation with said cup member;

an end cap made of soft magnetic material and having a diameter substantially equal to the diameter of said cup member including said flange for hermetically sealing the open end of said cup member;

an antenna;

means for coupling said antenna through said end cap to said resonant cavity; and a fitting board having a bore therethrough said bore having a diameter slightly larger than that of said cup member so that said cup member is insertable therethrough, and having a flange rest about said bore, said flange rest including a substantially horizontal and a substantially vertical portion, the closed end of said cup member being inserted through said bore such that said flange of said cup member engages said horizontal portion of said flange rest, said vertical portion oriented such that there is a gap between said vertical portion of said flange rest and said cup member, whereby said cup member is rotatable within said bore.

3. A magnetron according to either of claims 1 or 2 further comprising:

a substantially ring-shaped gasket-fitting member fitted to said end cap; and a gasket received in said gasket-fitting member;

said antenna coupled through said gasket and gasket-fitting member to said resonant cavity.

* * * * *